US010196182B2

(12) United States Patent
Roth et al.

(10) Patent No.: US 10,196,182 B2
(45) Date of Patent: Feb. 5, 2019

(54) CONTAINER WITH BOTTOM CAP

(71) Applicant: Cool Gear International, LLC, Plymouth, MA (US)

(72) Inventors: Donna Roth, Duxbury, MA (US); John D. Mason, Brockton, MA (US)

(73) Assignee: Cool Gear International, LLC, Plymouth, MA (US)

( * ) Notice: Subject to any disclaimer, the term of this patent is extended or adjusted under 35 U.S.C. 154(b) by 0 days.

(21) Appl. No.: 14/711,273

(22) Filed: May 13, 2015

(65) Prior Publication Data

US 2015/0329243 A1 Nov. 19, 2015

Related U.S. Application Data

(63) Continuation of application No. 29/490,722, filed on May 13, 2014, now Pat. No. Des. 738,163.

(60) Provisional application No. 61/992,311, filed on May 13, 2014.

(51) Int. Cl.

| | |
|---|---|
| ***B65D 43/02*** | (2006.01) |
| ***B65D 25/20*** | (2006.01) |
| ***B65D 81/36*** | (2006.01) |

(52) U.S. Cl.

CPC ..... *B65D 43/022* (2013.01); *B65D 25/20* (2013.01); *B65D 81/365* (2013.01); *B65D 2203/12* (2013.01); *B65D 2231/02* (2013.01); *B65D 2543/0049* (2013.01); *B65D 2543/00092* (2013.01); *B65D 2543/00546* (2013.01); *B65D 2543/00564* (2013.01)

(58) Field of Classification Search

CPC ..... A47G 2019/2244; A47G 19/2227; A47G 2019/2238

USPC ..... 220/729

See application file for complete search history.

(56) References Cited

U.S. PATENT DOCUMENTS

| | | | | | |
|---|---|---|---|---|---|
| 5,070,539 | A * | 12/1991 | Cheng | A47G 19/2227 | 220/737 |
| 5,990,790 | A * | 11/1999 | Lusareta | A47G 23/0306 | 206/459.1 |
| 8,344,902 | B2 * | 1/2013 | Chen | A47G 19/2227 | 340/384.73 |
| 8,550,288 | B2 * | 10/2013 | Briar | B65D 25/02 | 137/386 |
| D729,008 | S * | 5/2015 | Rankin | D7/507 | |
| 9,301,636 | B2 * | 4/2016 | Varnum | A47J 31/38 | |
| 2003/0210141 | A1 * | 11/2003 | Iacovino | B65D 81/3879 | 340/539.1 |
| 2006/0261233 | A1 * | 11/2006 | Williams | A47G 19/2227 | 248/311.2 |
| 2008/0264959 | A1 * | 10/2008 | Unda | B65D 1/265 | 220/711 |
| 2009/0114554 | A1 * | 5/2009 | Earnest | A47G 19/2227 | 206/217 |

* cited by examiner

*Primary Examiner* — Shawn M Braden

(74) *Attorney, Agent, or Firm* — Mintz Levin Cohn Ferris Glovsky and Popeo, P.C.; Jonathon P. Western

(57) ABSTRACT

A container includes a body defining an inner cavity, where the body has a top opening and a bottom opening, and a removable bottom cap that mates with the body such that the bottom cap covers the bottom opening. The bottom cap may include a seal member disposed on the bottom cap for fluidly sealing the bottom opening. The seal member may include a gasket or any other suitable seal.

17 Claims, 4 Drawing Sheets

CONTAINER WITH BOTTOM CAP

CROSS REFERENCE TO RELATED APPLICATIONS

This application claims priority to and the benefit of U.S. Application Ser. No. 61/992,311, filed May 13, 2014, and U.S. application Ser. No. 29/490,722, filed May 13, 2014, the full disclosures of which are hereby incorporated by reference in their entirety for all purposes.

FIELD OF THE INVENTION

This disclosure relates to containers, and more particularly, to containers having removable and/or multifunctional components.

BACKGROUND

Generally, containers (e.g., cups, water bottles, pitchers, etc.) include a single piece body for forming the container, since such a container is easy to manufacture. Such single piece containers generally have a simple design. Unfortunately, such containers may be difficult to clean, especially if the container has a complex three dimensional design such as, for example, a contoured or artistic shape. Moreover, it is very difficult to integrate multifunctional components into such containers. Solutions for providing improved containers are needed.

SUMMARY

In at least one aspect of this disclosure, a container includes a body defining an inner cavity, where the body defines a top opening and a bottom opening, and a removable bottom cap configured to mate with the body such that the bottom cap covers the bottom opening. The bottom cap may include a seal member disposed on the bottom cap for fluidly sealing the bottom opening. The seal member may include a gasket or any other suitable seal.

The bottom cap may define at least one electronics cavity. The bottom cap may further include at least one electronics component disposed within the electronics cavity. The at least one electronics component may include a speaker connected to a battery.

The battery may be removably connected to the bottom cap within the at least one electronics cavity. The battery may be accessible via a battery door configured to allow access to the battery. The bottom cap may further define at least one speaker hole in communication with the speaker for allowing sound to pass therethrough.

The bottom cap may also include an activation device configured to allow the speaker to activate. The activation device may include a button configured to at least partially protrude from the bottom cap.

The container and/or the bottom cap may further include a memory operatively connected to the battery and the speaker for providing an electrical signal to the speaker such that the speaker may convert the electrical signal into a predetermined sound.

The body may define a threading at or near the bottom opening and the bottom cap defines a threading that mates with the threading of the body for releasably attaching the bottom cap to the container. The body may also define a contoured or artistic shape.

In at least one aspect of this disclosure, a removable bottom cap for a container may include a mounting portion configured to mount to a container, wherein the mounting portion defines at least one cavity for a speaker and a battery, and a cover portion connected to the mounting portion and configured to at least partially cover the cavity to protect the speaker and the battery. In some embodiments, the mounting portion is threaded to mount to the container.

In some embodiments, the cover portion may include a battery door to allow access to the battery. The cover portion may define one or more speaker holes in fluid communication with the speaker to allow sound to pass therethrough. The cover portion may be removably mounted to the mounting portion. In some embodiments, the cover portion may be removably mounted to the mounting portion with at least one screw.

Other aspects and embodiments of this disclosure are discussed infra.

BRIEF DESCRIPTION OF THE DRAWINGS

The above and other objects, features and advantages of this disclosure will be more clearly understood from the following detailed description when taken in conjunction with the accompanying drawings, in which.

DETAILED DESCRIPTION OF THE EMBODIMENTS

Hereinafter reference will now be made in detail to various embodiments of the subject disclosure, examples of which are illustrated in the accompanying drawings and described below. While example embodiments are described, it will be understood that the present disclosure is not limited to those exemplary embodiments. On the contrary, this disclosure covers not only the embodiments described herein, but also various alternatives, modifications, equivalents and other embodiments, which may be included within the spirit and scope of the disclosure.

Ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "about" and similar terms (e.g., "substantially", "approximately") are understood as within a range of normal tolerance in the art, for example within 2 standard deviations of the mean. Such terms can be understood as meaning within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Figure 1:
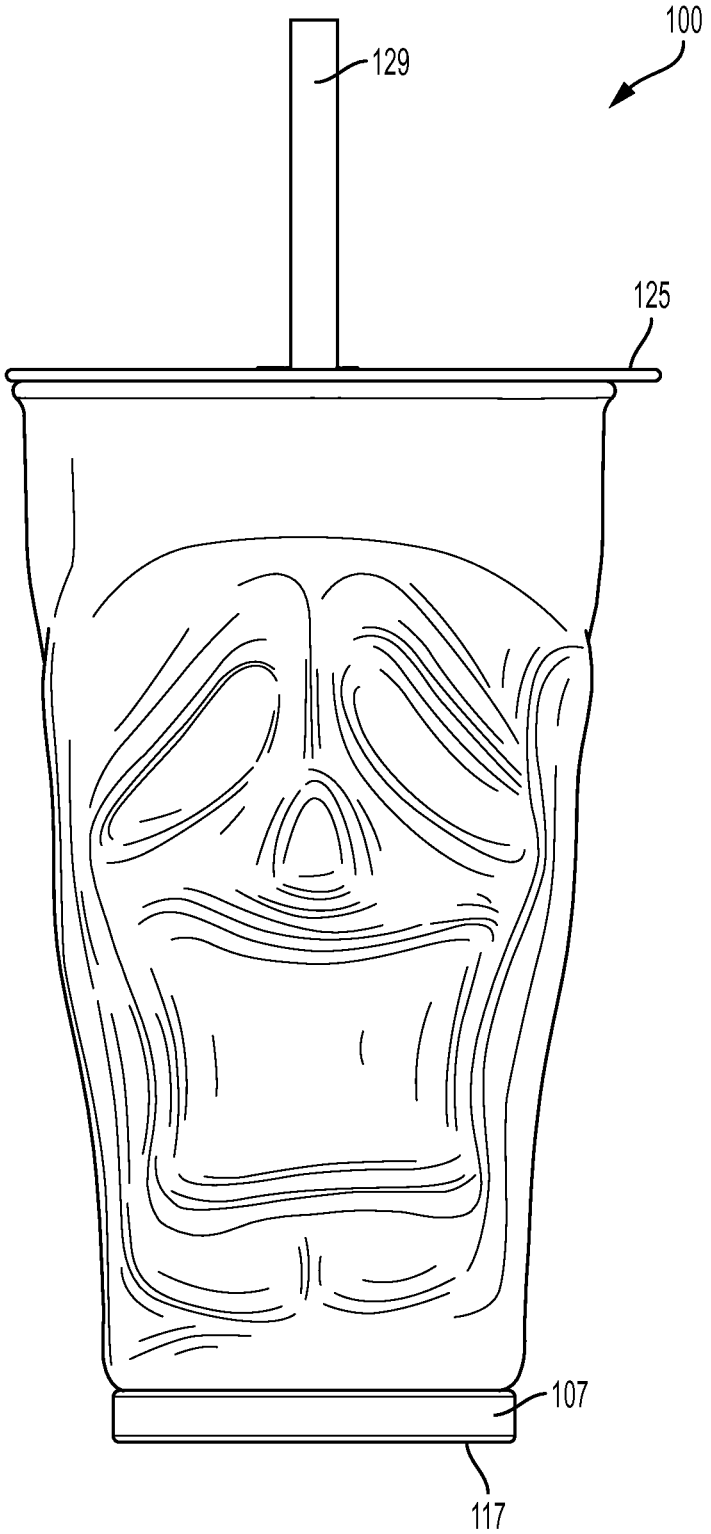
FIG. 1 is front elevation view of a container in accordance with an exemplary embodiment of the present disclosure.

Referring to FIG. 1, in at least one aspect of this disclosure, a container 100 includes a body 101 defining an inner cavity, a bottom cap 107, a top cap 125, a straw 129, and an activation device 117.

Figure 2:
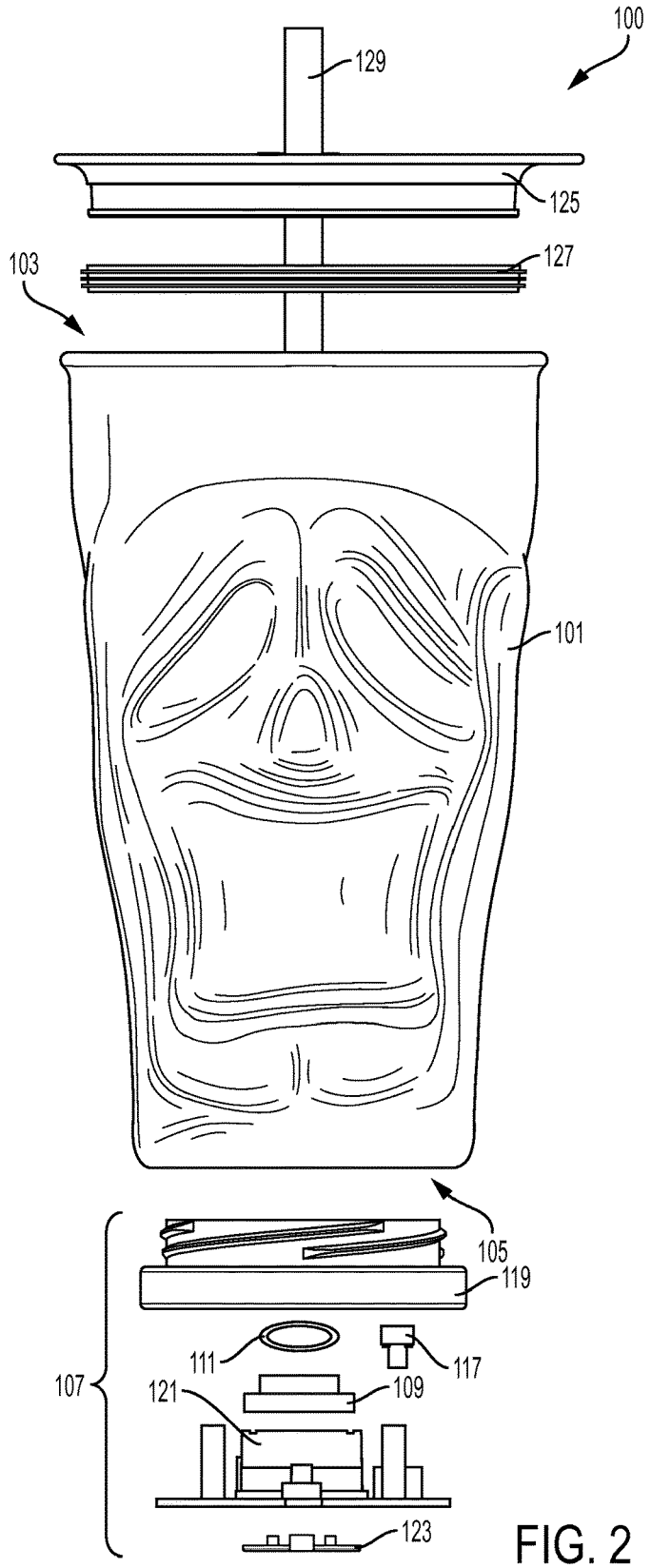
FIG. 2 is an exploded view of the container of FIG. 1.

As shown in FIG. 2, the body 101 may define a top opening 103 and a bottom opening 105. It should be understood by one having ordinary skill in the art that the bottom opening 105 may or may not be in fluid communication with the inner cavity of the body 101 and/or the top opening 103. The body 101 may define any suitable shape (e.g., frusto-conical, cylindrical, contoured, artistic, or the like), and the container 100 may be any suitable type of container (e.g., a cup, bottle, or the like). The body 101 may also define a contoured or artistic shape (e.g., a ghoul face, as shown). The container 100 may also include a top cap 125 for covering the top opening 103 of body 101. The top cap 125 may also be operatively associated with a seal member 127 for fluidly sealing the top opening 103. It is also contemplated that the top cap 125 may be configured to allow a straw 129 to pass therethrough.

The container 100 may also include a removable bottom cap 107 configured to mate with the body 100 such that the bottom cap 107 covers the bottom opening 105. The bottom cap 107 may include a seal member (not shown) disposed on and/or around the bottom cap 107 for fluidly sealing the bottom opening 105 in embodiments where the bottom opening 105 is in fluid communication with the inner cavity of the body 101. The seal member may include a gasket or any other suitable seal.

The bottom cap 107 may define at least one internal electronics cavity for holding one or more electronic components (e.g., an audio speaker, an illumination source, and the like). The bottom cap 107 may further include one or more electronic components disposed within the electronics cavity including, but not limited to, a speaker 109 and a battery 111. The battery 111 may be removably connected to the bottom cap 107 within the electronics cavity. The battery 111 may be accessible via a battery door 123 configured to allow access to the battery 111.

In at least one aspect of this disclosure, the bottom cap 107 may include a mounting portion 119 configured to mount to the container 101. As shown in FIG. 2, the mounting portion 119 may be configured for a threadable attachment. However, the type of attachment configuration is not limited to a threadable attachment, but may also include any of a variety of attachment means known to one of skill in the art including, but not limited to, a pressure fit, a twist lock, a snap fit, and the like. The mounting portion 119 may define at least one cavity for a speaker 109 and/or a battery 111.

The body 101 may define a threading at or near the bottom opening 105 and the mounting portion 119 may include a threading that mates with the threading of the body 101 for releasably attaching the bottom cap 107 to the container.

The bottom cap 107 may further include a cover portion 121 connected to the mounting portion 119 and configured to at least partially cover the cavity to protect and/or retain the speaker 109 and the battery 111 within the cavity. In some embodiments, the mounting portion is threaded to mount to the container.

Figure 3:
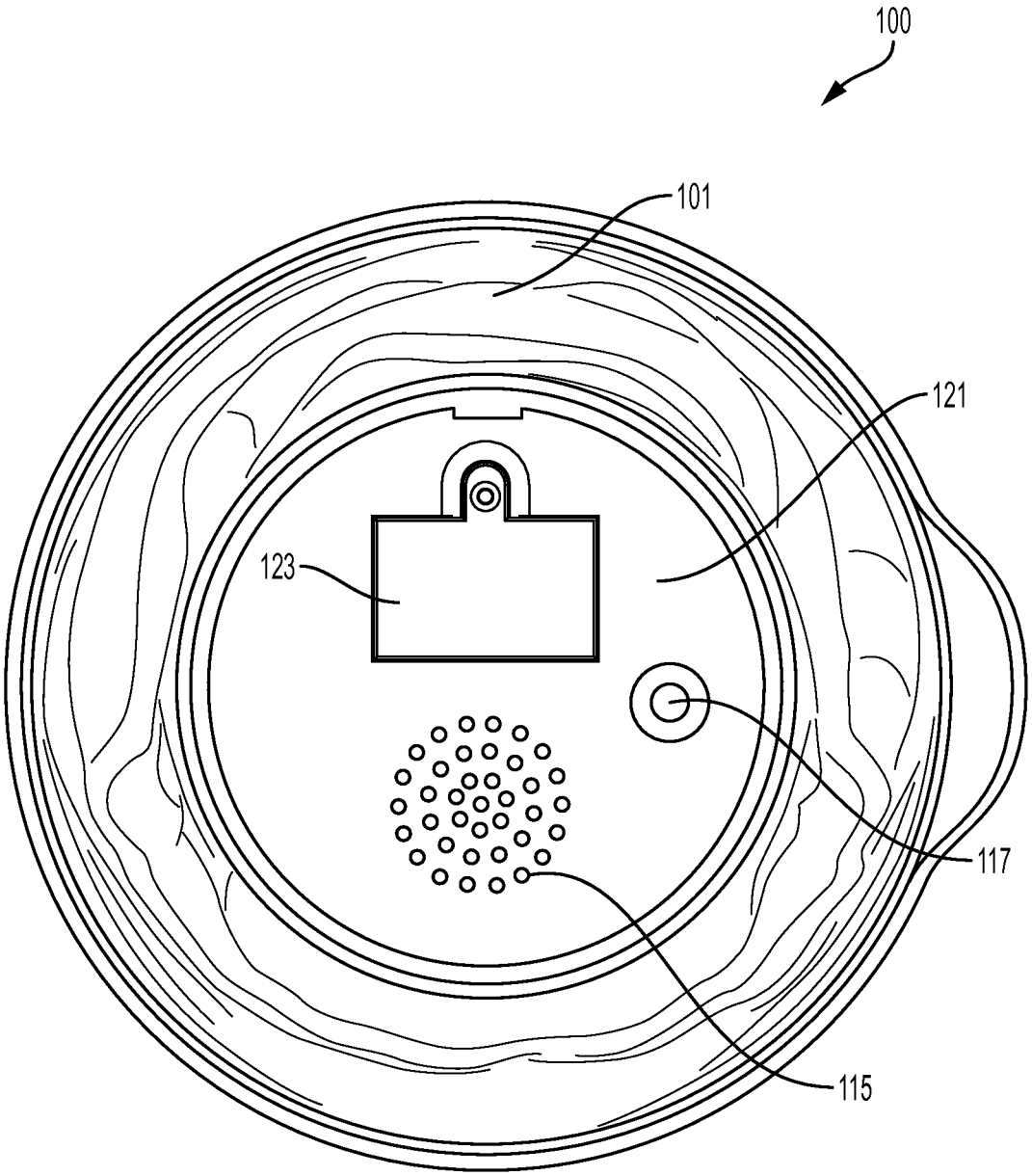
FIG. 3 is a bottom plan view of the container of FIG. 1, showing various features of an exemplary embodiment of a bottom cap in accordance with the present disclosure.
Figure 4:
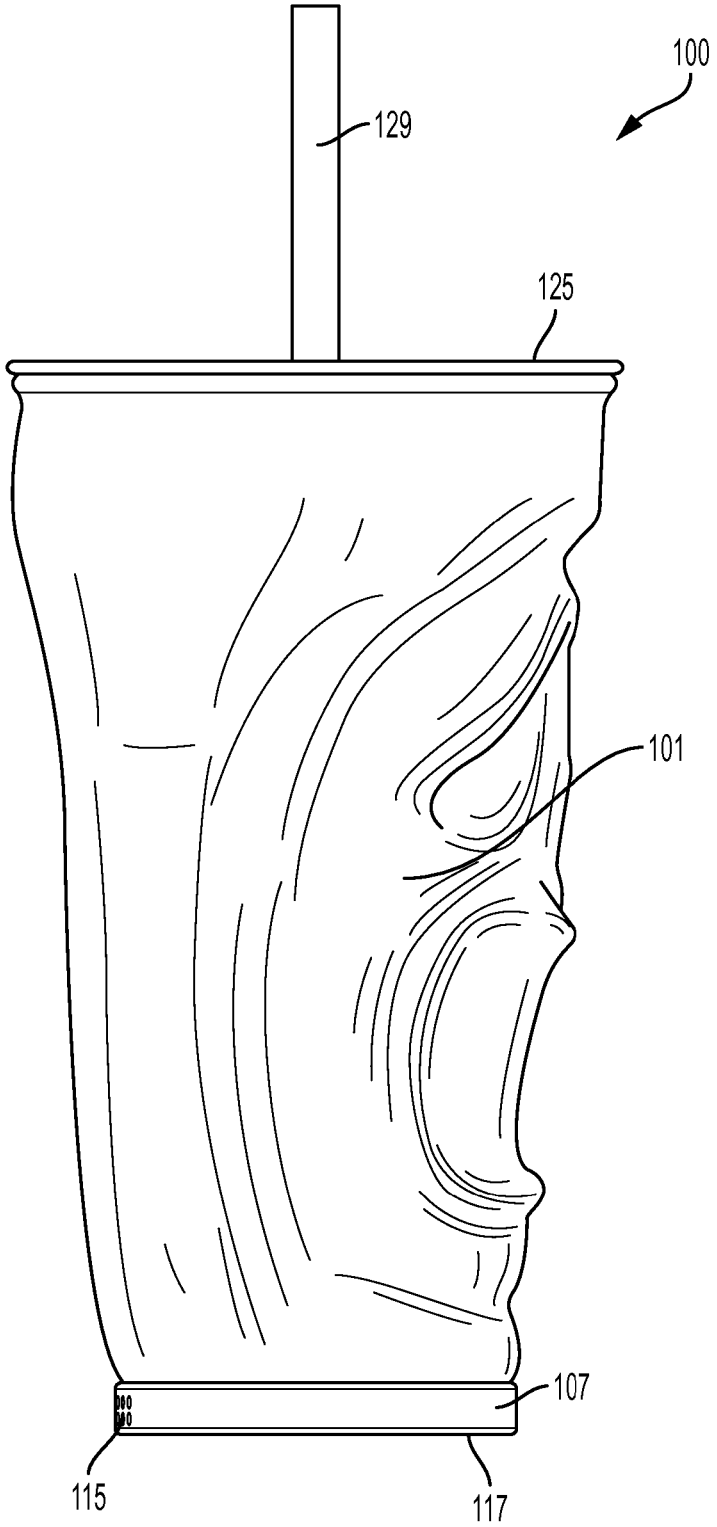
FIG. 4 is a side view of the container of FIG. 1, showing speaker holes disposed on a side surface of a bottom cap disposed thereon.

As shown in FIGS. 3 and 4, the bottom cap 107 may further define one or more speaker holes 115 in communication with the speaker 109 for allowing sound to pass therethrough. The speaker holes 115 may form any suitable array and/or pattern. In some embodiments, the speaker holes 115 may face downward away from the container 100. Alternatively or additionally, speaker holes 115 may also be formed in a side surface of the bottom cap 107 facing radially outward relative to a longitudinal axis of the container 100 (see e.g., FIG. 4).

The container 100 and/or the bottom cap 107 may further include a memory operatively connected to the battery and the speaker 109 for providing an electrical signal to the speaker 109 such that the speaker 109 may convert the electrical signal into one or more predetermined sounds (e.g., a ghoul scream, ghoul laughter, and the like).

The bottom cap 107 may also include an activation device 117 configured to allow the speaker 109 to activate and/or receive a signal from the battery and/or memory operatively associated therewith. The activation device 117 may include a button configured to at least partially protrude from the bottom cap 107. In such cases, the activation device 117 may cause a sound to be made each time the container 100 is placed on the bottom cap 107, or when the container 100 is lifted up from, or set down upon, a surface.

In some embodiments, the cover portion 121 may include a battery door 123 to allow access to the battery 111. The battery door 123 may be attached in any suitable manner such as, but not limited to, hinges, screws, clips, and the like. The cover portion 121 may define the one or more speaker holes 115 described above, such that the speaker holes 115 are in audio communication with the speaker 109 to allow sound to pass therethrough. The cover portion 121 may be removably or permanently mounted to the mounting portion 119 in any suitable fashion (e.g., bonding, welding, screws, hinges, clips, etc.). In some embodiments, the cover portion 121 may be removably mounted to the mounting portion with at least one screw such that the battery may be removed or replaced.

Any of the herein described components of the various embodiments of a container 100 may made with any suitable materials, including, but not limited to, plastic, metal, and/or ceramics. Any seal/gasket herein disclosed may be made of any suitable sealing material such as, but not limited to, rubber, plastic, soft plastic, and/or foam.

While the disclosed embodiments have been described in detail, it will be appreciated by those skilled in the art that changes may be made in these embodiments without departing from the principles and spirit of the disclosure.

What is claimed is:

1. A container, comprising:

a cap having a hole therethrough;

a straw configured to interface with the hole in the cap;

a body defining an inner cavity, a top opening, and a bottom opening, wherein the top opening is configured to reversibly receive the cap, and the inner cavity is in fluid communication with the top opening and the bottom opening; and a removable bottom cap having a top end and an electronics compartment, wherein the top end is configured to reversibly mate with the bottom opening of the body such that the bottom cap covers the bottom opening, and the electronics compartment contains a battery, speaker, processor, and memory and an activation device, wherein the electronics compartment is integral with the bottom cap such that the electronics compartment and the bottom cap are inseparable, and when the bottom cap mates with the bottom opening, a wall of the electronics compartment is positioned to be in contact with a fluid that is disposed in the inner cavity.

2. The container of claim 1, wherein the bottom cap includes a seal member disposed on the bottom cap for fluidly sealing the bottom opening.

3. The container of claim 2, wherein the seal member includes a gasket.

4. The container of claim 1, wherein the battery is removably connected to the bottom cap within the electronics compartment.

5. The container of claim 4, wherein the battery is accessible via a battery door configured to allow access to the battery.

6. The container of claim 1, wherein the bottom cap further defines at least one speaker hole in fluid communication with the speaker for allowing sound to pass therethrough.

7. The container of claim 1, wherein the activation device is configured to turn the speaker on or off.

8. The container of claim 7, wherein the activation device includes a button configured to at least partially protrude from the bottom cap.

9. The container of claim 1, further comprising a memory operatively connected to the battery and the speaker for providing an electrical signal to the speaker such that the speaker may convert the electrical signal into a predetermined sound.

10. The container of claim 1, wherein the body defines a threading at or near the bottom opening and the bottom cap defines a threading that mates with the threading of the body for releasably attaching the bottom cap to the container.

11. The container of claim 1, wherein the body defines a contoured or artistic shape.

12. A removable bottom cap for a container having a body defining an inner cavity, a top opening, and a bottom opening, a cap having a hole therethrough, a straw configured to interface with the hole in the cap, wherein the top opening is configured to reversibly receive the cap, and the inner cavity is in fluid communication with the top opening and the bottom opening, the removable bottom cap comprising:

a mounting portion configured to mount to the container; and an electronics compartment containing a speaker and a battery, the electronics compartment including a cover portion configured to at least partially enclose the electronics compartment to protect the speaker and the battery, wherein the electronics compartment is integral with the mounting portion such that the electronics compartment and the mounting portion are inseparable, and when the mounting portion mounts to the container, a wall of the electronics compartment is positioned to be in contact with a fluid that is disposed in the inner cavity.

13. The container of claim 5, wherein the battery door includes an inner surface facing a plurality of electronic components contained inside of the electronics compartment and an outer surface opposite of the inner surface, and the battery door is disposed on the bottom cap such that the outer surface of the battery door faces outwardly with respect to the bottom opening.

14. The container of claim 1, wherein the bottom cap seals the bottom opening so as to substantially prevent flow of a fluid in the inner cavity through the bottom opening.

15. The container of claim 1, wherein, when the bottom cap mates with the bottom opening, and when a fluid is disposed in the inner cavity, the bottom cap is in contact with the fluid.

16. The removable bottom cap of claim 12, wherein the cover portion is removably mounted to the electronics compartment.

17. The removable bottom cap of claim 16, wherein the cover portion is removably mounted to the electronics compartment with at least one screw.

* * * * *